US008060963B2

(12) United States Patent
Ronchi

(10) Patent No.: US 8,060,963 B2
(45) Date of Patent: Nov. 22, 2011

(54) DYEING DEVICE AND PROCESS USING INDIGO AND OTHER COLORANTS

(75) Inventor: Francesco Ronchi, Sovico (IT)

(73) Assignee: MASTER S.a.s. di Ronchi Francesco & C., Macherio-Milan (IT)

( * ) Notice: Subject to any disclaimer, the term of this patent is extended or adjusted under 35 U.S.C. 154(b) by 1333 days.

(21) Appl. No.: 11/572,423

(22) PCT Filed: Jul. 27, 2005

(86) PCT No.: PCT/IB2005/002403

§ 371 (c)(1),
(2), (4) Date: Jan. 20, 2007

(87) PCT Pub. No.: WO2006/013458

PCT Pub. Date: Feb. 9, 2006

(65) Prior Publication Data

US 2008/0040870 A1 Feb. 21, 2008

(30) Foreign Application Priority Data

Jul. 29, 2004 (IT) ..... MI2004A1553

(51) Int. Cl.
*D06B 5/18* (2006.01)

(52) U.S. Cl. ..... 8/151.2; 8/149.3; 8/150; 68/5 R; 68/7; 68/9

(58) Field of Classification Search ..... 68/5 R, 68/7, 8, 5 C, 5 D, 5 E, 9, 11, 21, 94, 95, 112; 8/149.1, 149.2, 149.3, 150, 151.2
See application file for complete search history.

(56) References Cited

U.S. PATENT DOCUMENTS

| | | | | | |
|---|---|---|---|---|---|
| 4,136,535 | A | * | 1/1979 | Audas | 68/5 E |
| 4,182,141 | A | * | 1/1980 | Sando et al. | 68/5 E |
| 4,313,235 | A | * | 2/1982 | Gotovtseva et al. | 8/149.1 |
| 4,393,671 | A | * | 7/1983 | Ito | 68/5 C |
| 5,815,867 | A | * | 10/1998 | Keasler et al. | 8/149.1 |
| 5,922,084 | A | | 7/1999 | Fuchs et al. | |
| 6,123,741 | A | | 9/2000 | Girbault et al. | |

FOREIGN PATENT DOCUMENTS

| | | |
|---|---|---|
| CA | 1098258 | 3/1981 |
| DE | 4223556 | 1/1994 |
| DE | 4342313 | 6/1995 |
| EP | 533286 | 6/1996 |

* cited by examiner

*Primary Examiner* — Joseph L Perrin
*Assistant Examiner* — Benjamin Osterhout
(74) *Attorney, Agent, or Firm* — Themis Law

(57) ABSTRACT

A continuous dyeing device and related processes using indigo and/or other colorants for warp yarn chains and/or for fabrics, equipped with at least a first and a second dyeing compartments containing dyeing baths, the first and second dyeing compartments being enclosed, at least partially, in a hermetically sealed chamber. The device also includes at least one squeezing element interposed between the two dyeing compartments and a plurality of cylinders for heating and/or dehydrating the yarn and or the fabric, thereby increasing the diffusion and the absorption of the colorant. The cylinders are positioned downstream of the first dyeing compartment and squeezing element.

37 Claims, 6 Drawing Sheets

DYEING DEVICE AND PROCESS USING INDIGO AND OTHER COLORANTS

BACKGROUND OF THE INVENTION

1. Field of the Invention

The present invention relates to a dyeing device and to processes using indigo and/or other colorants, to which the warp yarn chain and/or fabrics are exposed in a continuous manner. In particular, the present invention relates to a continuous dyeing device and to processes in dyeing machines and/or plants that operate with reduction baths and at high or low temperatures. A typical application of this dyeing technology is that of the continuous dyeing of the warp chain for denim fabric, using indigo or other colorants, such as sulphur, indanthrene and reactive based colorants.

2. Description of Related Art

Denim is the fabric normally used for the manufacturing of jeans and other sportswear articles, and is the fabric used in the greatest quantity throughout the world. Traditional denim is manufactured by weaving pre-dyed cotton yarn; in particular, only the warp is dyed in a continuous manner with indigo or other colorants, whereas the fill is used in its raw state.

Typically, the dyeing of the warp chain for denim fabrics is performed using both rope and shift systems in open vats at low temperature, using indigo, an ancient natural colorant that is currently produced by synthesis. The dyeing method required for the application of indigo colorant on cotton yarn is tailored to this colorant, because said colorant has a relatively small molecule with reduced affinity for cellulose fiber, and, therefore, for the application on said fiber, it needs to be not only chemically reduced in an alkaline bath (in leuco form) but also a plurality of impregnations are required with squeezing and oxidation stages in the air, between each bath.

Therefore, in order to obtain medium or dark blue denim, the yarn must be subjected to a first dyeing process (impregnation, squeezing, oxidation) immediately followed by other over-dyeing stages: the greater the number of stages, the darker the color, and the stronger the solidity of the required color.

The above described dyeing process is currently applied to the warp chain, using indigo in all known machines and installations in a continuous manner, for both rope and shift systems. More precisely, the machines described above are normally composed of 2 or more pre-treatment vats, 8 or more dyeing vats that include the related squeezing and oxidation units, followed by 3 or more units for final washing stages. The dyeing vats are connected to each other by a circulation system for mixing, changing and strengthening the dye bath, according to a known system, not described herein.

It is known that the dyeing in these machines is performed in an alkaline environment and with a calculated excess of sodium hydrosulphite and that, as a result of the bath/air contact, the sodium hydrosulphite reacts with the oxygen in the air losing its reducing capacity towards the indigo.

Because sodium hydrosulphite oxidizes easily, metered quantities of hydrosulphite must be added to the dyeing bath to contrast this loss.

This reintegration of the sodium hydrosulphite with stechiometrically corresponding amounts of caustic soda must be performed with regularity and precision, in order to keep the dyeing capacity of the bath unaltered, and to guarantee constant and repeatable results.

Among the aforesaid machines, those used in shift dyeing systems are then connected in line within dyeing installations to a slashing machine, that performs the slashing, the drying, and the winding of the dyed yarn on a beam, ready to be placed on the loom.

The aforesaid dyeing machines must be constructed respecting determined basic parameters in relation to the immersion and oxidation times, and to permit the yarn to absorb the dye in the best possible conditions, and after squeezing, to be completely oxidized before entering into the following bath, so that the color can be intensified, in other words so that the color tone can be darkened.

The average immersion time for the yarn in the dyeing bath is normally approximately 8-12 seconds, while the oxidation time after squeezing is approximately 60 seconds, which means that the yarn must remain exposed to air for 60 seconds before it can be immersed again in the following vat, and then this process is repeated for all the vats.

A reduced oxidation time is possible only with machines equipped with oxidation intensification devices, such as those described in patent no. EP533286 by Applicant.

The average dyeing speed can be calculated as approximately 30 meters per minute, meaning an average length of 6-8 meters of yarn immersed in each bath, while the length of yarn exposed to air between one bath and another is at least 30 meters and more. Therefore, considering a machine with eight dyeing vats as a basic installation, a substantial length of yarn runs through the dyeing baths and the relative oxidation devices, since, by multiplying: 6 m×8+30 m×8, this equals 288 meters.

These 288 meters of yarn, added to the much shorter lengths of yarn being processed in the other component machines on the same line (dyeing machine+slasher) reach a total of 400-500 meters, making the line difficult to control, and at each batch change, certain quantities are considered as lost, because the dyeing is not uniform and because of problems connected to the start-up of a new batch.

The aforesaid machines must also be adaptable to dyeing processes with other colorants, such as the aforesaid sulphur, indanthrene and reactive based colorants, which require different methods from those used for indigo. These machines, which use different processes from those used for indigo dyeing, require flexibility and adaptability, so that cost increases connected to the installation of specific dyeing systems can be contained.

BRIEF SUMMARY OF THE INVENTION

In light of what has been described above, there is a need for a dyeing device and process that will provide a considerable reduction in the yarn rejects between each batch, as well as a reduction in the size, and consequently the cost, of dyeing installations.

Therefore, the purpose of the present invention is to provide a dyeing device that in one or more units can be used in continuous dyeing processes using indigo, and which will not only reduce the number of the vats normally used in the prior art, with the relative and consequential economical advantages, but which will also make it possible to reduce the reject material in each batch.

Another purpose of the present invention is to supply a device and a process that can operate in an inert environments, enabling a reduction in the consumption of hydrosulphite and soda in indigo dyeing.

Another purpose of the present invention is to provide a device and process that enables the increase of colorant diffusion in the fiber during indigo dyeing, and to increase the pick-up capacity of the colorant itself.

A further purpose of the present invention is to provide a device and process for dyeing using colorants with high affinity such as sulphur, indanthrene and reactive colorants.

Another purpose of the present invention is to provide a device and process that optimizes use of indanthrene colorants for dyeing with the pigmentation method and with reactive colorants using the two-stage method.

Another purpose of the present invention is to provide the possibility of dyeing in small batches, or with reduced yardage, to meet market demands.

These and other purposes are achieved by the continuous dyeing device and process using indigo and/or other colorants for warp chain according to the present invention as described in the appended claims.

Briefly, a continuous dyeing device using indigo and/or other colorants for warp chains according to the present invention is equipped with at least a first and a second dyeing compartments, suitable for containing dyeing vats, enclosed at least partially in a hermetically sealed chamber. The device comprises at least one squeezing element, interposed between the two dyeing compartments, and at least one means for heating and/or dehydrating the yarn to increase the diffusion of the colorant in the fiber and the pick up of the colorant, positioned downstream of the first dyeing compartment and the squeezing element.

BRIEF DESCRIPTION OF THE SEVERAL VIEWS OF THE DRAWINGS

Further characteristics and advantages of the present invention will be made clearer in the following description of embodiments of the invention, not to be considered limiting in any manner, with reference to the appended drawings wherein.

DETAILED DESCRIPTION OF THE INVENTION

The aforesaid figures show a continuous dyeing device using indigo and/or other colorants such as sulphur, indanthrene or reactive based colorants for warp chains constructed according to the present invention. For greater descriptive clarity, hereafter reference will be made to warp chains only, even though the invention also applies to fabrics.

Figure 1:
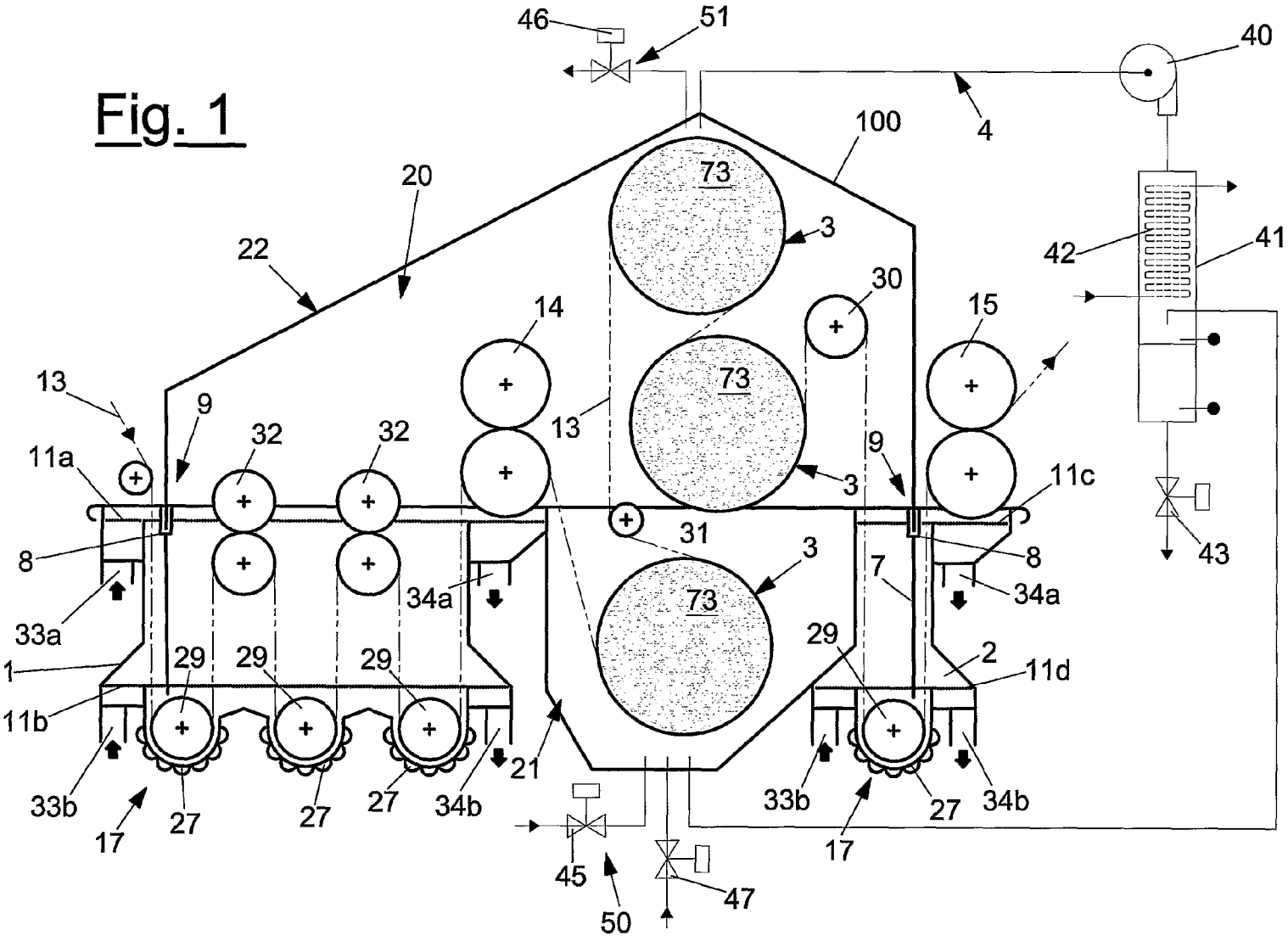
FIG. 1 shows a side view in elevation of a dyeing device according to the present invention.

As can be seen in FIG. 1, the dyeing device, identified throughout by the reference numeral 100, is of the type equipped with at least two dyeing compartments 1, 2, adapted to contain the dyeing baths 11*a*, 11*b*, 11*c*, 11*d*, and in turn, contained, at least partially, in a hermetically sealed chamber 20. The device 100, also comprises at least one squeezing element 14, interposed between the two dyeing compartments 1 and 2, and at least one means 3 for directly heating and/or dehydrating the yarn 13. The direct heating of the yarn 13 increases the diffusion of the colorant in the fiber after the impregnation in dyeing compartment 1, while the consequent dehydration caused by the evaporation of the water contained in the yarn, according to the type of colorant employed, prevents hydrolysis and/or provides greater pick up of the colorant in the following dyeing compartment 2. Advantageously, according to the present invention, the means 3 for direct heating and/or dehydration of the yarn 13 is positioned upstream of the second compartment 2.

In this manner, the dehydration of the yarn 13 provides for the yarn to increase the absorption capacity in the second bath, in compartment 2, which would otherwise be almost zero.

Chamber 20, hermetically sealed, comprises at least one base 21, in turn comprising the two dyeing compartments 1 and 2 and at least one hood 22, that can be raised and reclosed over the base 21 to facilitate cleaning and maintenance interventions. Chamber 20 is hermetically closed thanks to special sealing means 9. In particular, in the preferred embodiment shown in FIGS. 1-5, the sealing means 9 are represented by a hydraulic seal around the perimeter that is made with the base 21, comprising the two compartments 1 and 2, containing the baths 11*a*, 11*b*, 11*c*, 11*d*, that extend partially out from the side walls of the hood 22, and at least one dividing wall 7 for each compartment 1 and 2.

Each dividing wall 7 is attached to the respective compartment 1 or 2, goes down into the baths 11*a*, 11*b*, 11*c*, 11*d*, as shown in the figures, and has a seat 8 adapted to engage with the hood 22 to achieve hermetic sealing.

As an alternative, said hermetic sealing means 9 could be formed by gaskets (not shown) interposed between the hood 22 and the base 21, while remaining within the context of the present invention.

The means 3 for directly heating the yarn 13 are illustrated in the preferred embodiment shown in the figures, as heated cylinders 73, preferably cylinders heated by a fluid. More precisely, three heated cylinders 73 are illustrated, over which the yarn 13 passes, arranged in a line one behind the next, directly upstream of the second dyeing compartment 2.

According to the type of colorant used in the dyeing process, the cylinders 73 may also not be heated. In order to heat or not heat the cylinders 73 as required, a switch-controlled means is included, not shown, and adapted to activate or exclude the heating of cylinders 73.

Said switch-controlled means are of the known type, or in any case, can be easily realized by those skilled in the art, and therefore will not be described herein. Said direct heating means 3 for the yarn 13 could also be produced alternatively using an infrared source adapted to heat the yarn 13 directly by irradiation or by using microwave or radio frequency sources adapted to heat the yarn 13 directly.

However, it must be noted that whatever appropriate means are used for heating the yarn 13, such means will remain within the scope of the present invention. As a further example, the yarn 13 could be subjected to at least an inert dehumidified hot fluid flow.

Upstream of the means 3 for direct heating of the yarn 13, as stated previously, a squeezing means 14 is provided, capable of applying strong pressure on the yarn 13. More precisely, the squeezing element 14 is able to apply pressure on the warp chain 13 in a range between 3 and 20 tons.

Preferably, the squeezing element 14 is composed of two cylinders opposite each other, and is able to apply pressure on the warp chain 13 in a range between 5 and 12 tons. This squeezing strength is applied on the yarn 13 as it exits from the first dyeing compartment 1 and eliminates any excess bath liquid from the yarn 13 in an excellent manner.

Moreover, as can be seen in FIG. 1, the dyeing compartments 1 and 2 are also equipped with at least one means 17 for a heating or cooling action on the dyeing baths 11*a*, 11*b*, 11*c*, 11*d*, such means being indirect and without any contact on the vats.

In particular, the compartments 1 and 2 each include at least one coil 27 inside which a heating or cooling liquid circulates to heat or cool the dyeing baths 11*a*, 11*b*, 11*c*, 11*d*, according to the dyeing process, in an indirect manner and without any contact with the vats contained in compartments 1 and 2.

For this purpose, the coils 27 form, in a known way, a cavity in proximity to the bottom of the compartments 1 and 2.

Additional return rollers 30 and 31 are present inside the chamber 20, and are adapted to define the path of the yarn 13 inside the chamber 20.

Compared to dyeing compartment 2, the dyeing compartment 1 has a larger yarn content, and consequently a larger vat in order to take best advantage of the dyeing affinity of the colorants. In other words, the dyeing compartment 1 has a larger yarn capacity than compartment 2.

Advantageously, according to the present invention, there are also three immersion rollers 29 positioned in proximity to the bottom of compartment 1 and another in proximity to the bottom of compartment 2, to force the yarn 13 to pass through the dyeing baths near the bottom of the compartments 1 and 2.

The three immersion rollers 29 in the dyeing compartment 1 are interposed by two intermediate squeezing elements 32 adapted to apply light pressure, that is—less than 6 tons, but preferably less than 1 ton, on the yarn 13. The pressure applied by the intermediate squeezing elements 32 facilitates the penetration of the colorants in the yarn 13 and provide greater color uniformity.

The two compartments 1 and 2 advantageously present overflow type entries 33*a*, 33*b* and exits 34*a*, 34*b*.

Figure 2:
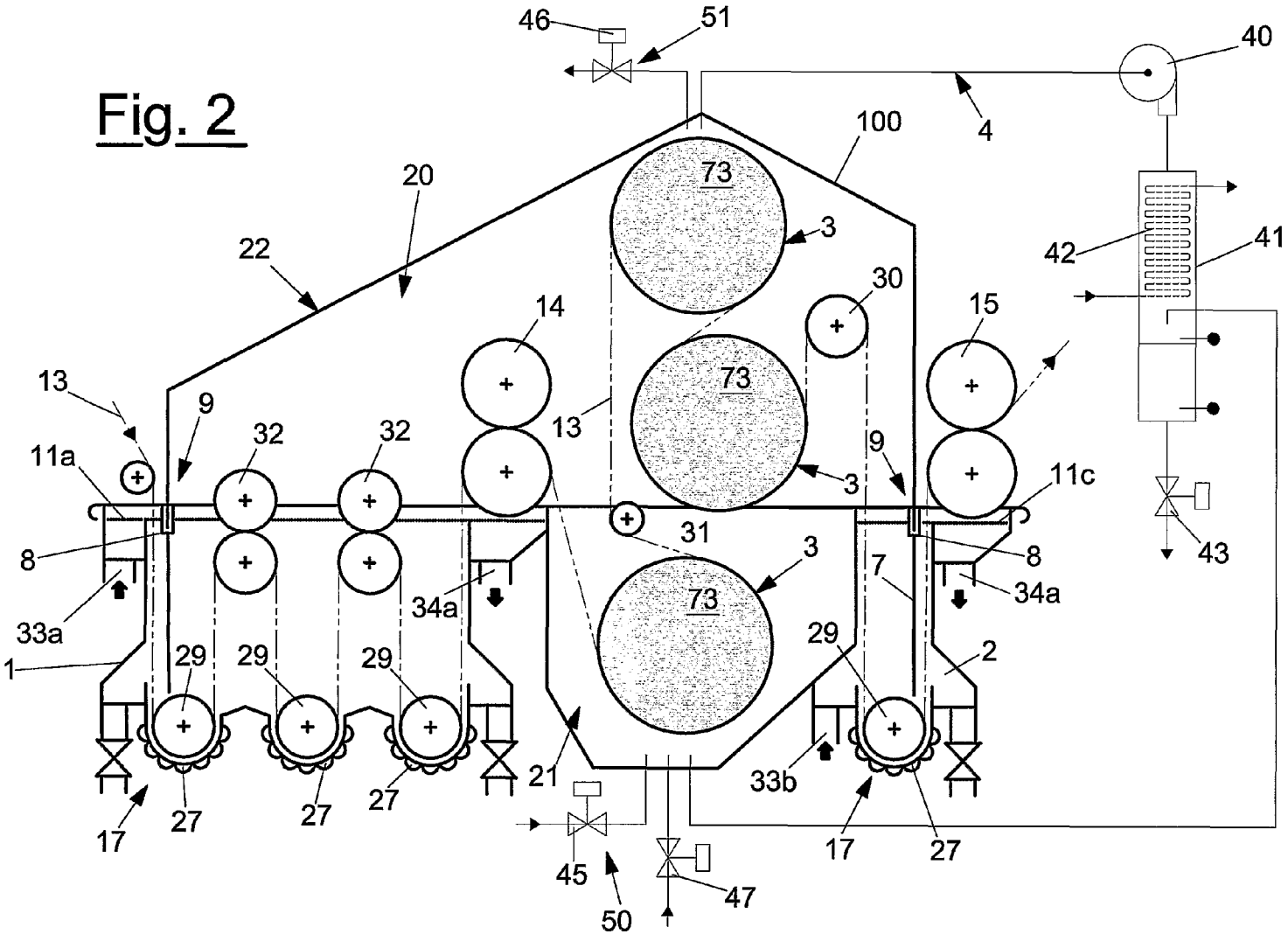
FIG. 2 shows a side view in elevation of a dyeing device according to the present invention used for a continuous dyeing process of the warp chain using indigo.

More precisely, in the case of indigo dyeing, the two compartments 1 and 2 preferably operate with a single bath 11*a*, 11*c* at maximum level, with the feeding respectively from the overflow entries 33*a*, 33*b*, and with the downflow from the two overflow exits 34*a*, as shown in FIG. 2.

During indigo dyeing, the compartments 1 and 2 are placed in communication by means of a known hydraulic circuit, and therefore not described herein. The hydraulic circuit that provides fluid communication between the two compartments 1 and 2 can however be closed to prevent dyeing bath communication between the two compartments 1 and 2, as in the case of dyeing operations using indanthrene or reactive colorants. Therefore, the two dyeing compartments 1 and 2 can operate using different baths and/or different bath levels according to the dyeing process underway.

More precisely, in the case of dyeing with indanthrene and reactive colorants, the two compartments 1 and 2 preferably operate with the two different baths 11*b* and 11*d*, and at minimum level, with feeding from the overflow entries 33*b* and downflow from the overflow exits 34*b*.

When dyeing with sulphur, indanthrene or reactive based colorants, the two compartments 1 and 2 are connected to the relative hydraulic circuits (independent from that used for indigo dyeing) that can be cut off using valves, said circuits being of a known type and therefore not described any further herein. When the baths are at a low level, the compartments 1 and 2 provide the maximum yarn/bath contact time but with the minimum bath fluid possible, an essential step for eliminating the known defect of coloring differences between the head and tail of the yarn, an effect that occurs with colorants other than indigo because of their greater affinity, when vats with large quantities of liquid are used.

Compartments 1 and 2 can be used with a maximum yarn content and a minimum bath liquid because of the special shape of the bottom of the compartments 1 and 2 around the rollers 29.

The device 100 according to the present invention also includes an element 15, for adequate squeezing positioned downstream of the second compartment 2 to eliminate any excess bath liquid from the yarn 13 as it exits from the chamber 20 before the following oxidation or steaming stage. In particular, said squeezing element 15 is positioned outside the chamber 20, so that it is directly downstream of the second compartment 2. Furthermore, the device 100 also comprises means for drawing in fluid mixed with steam from the chamber 20.

For this reason, the device 100 according to the present invention includes a closed circuit 4 for steam suction adapted to draw in fluid with the steam from the chamber 20, and if necessary, according to the dyeing process being performed by the device, it can also return said dehumidified fluid to the chamber 20.

As shown in FIG. 1, the suction circuit 4 presents at least one steam suction means 40, such as a centrifugal suction means, adapted to draw in the fluid with the steam from chamber 20, and at least one heat exchanger 41 to condense the steam from chamber 20 and send back the dehumidified fluid to the said chamber 20.

In a known way, the heat exchanger 41 comprises a coil 42 crossed by a coolant, and a discharge valve 43 for the water that condenses at the bottom of the heat exchanger 41.

The suction circuit 4 may include a further three-way discharge valve, not shown, positioned upstream of the heat exchanger 41 for direct discharge of steam to the exterior during the dyeing processes using sulphur, reactive or indanthrene colorants; in this case a valve 47 will introduce air into the chamber 20.

In order to reduce the consumption of the hydrosulphite and soda used in indigo dyeing baths 11*a* and 11*c*, and to provide for the heating and dehydration of the yarn without oxidation of the colorant contained in the yarn, the device 100 according to the present invention can operate in an inert environment.

Accordingly, means 50 may be provided for introducing deoxygenated air and/or nitrogen into the chamber 20 and means 51 for the extraction of oxygen from the chamber 20, in order to create a deoxygenated and, therefore, inert processing environment inside the chamber 20. The means 50 for the introduction of deoxygenated air/nitrogen inside chamber 20 comprise an inlet valve 45 connected to a source of pressurized deoxygenated air or nitrogen, not shown. Conversely, the means 51 for the extraction of oxygen comprise a discharge valve 46.

An initial flow of nitrogen or deoxygenated air for a determined period of time with valve 46 open will permit the exit of the oxygen from the chamber 20, because of over-pressure and difference of specific weight.

The flow time necessary to create an inert environment inside chamber 20 is determined by instrumental measurement of the internal conditions of chamber 20, or alternatively, by assessments and calculations made by experts.

Figure 4:
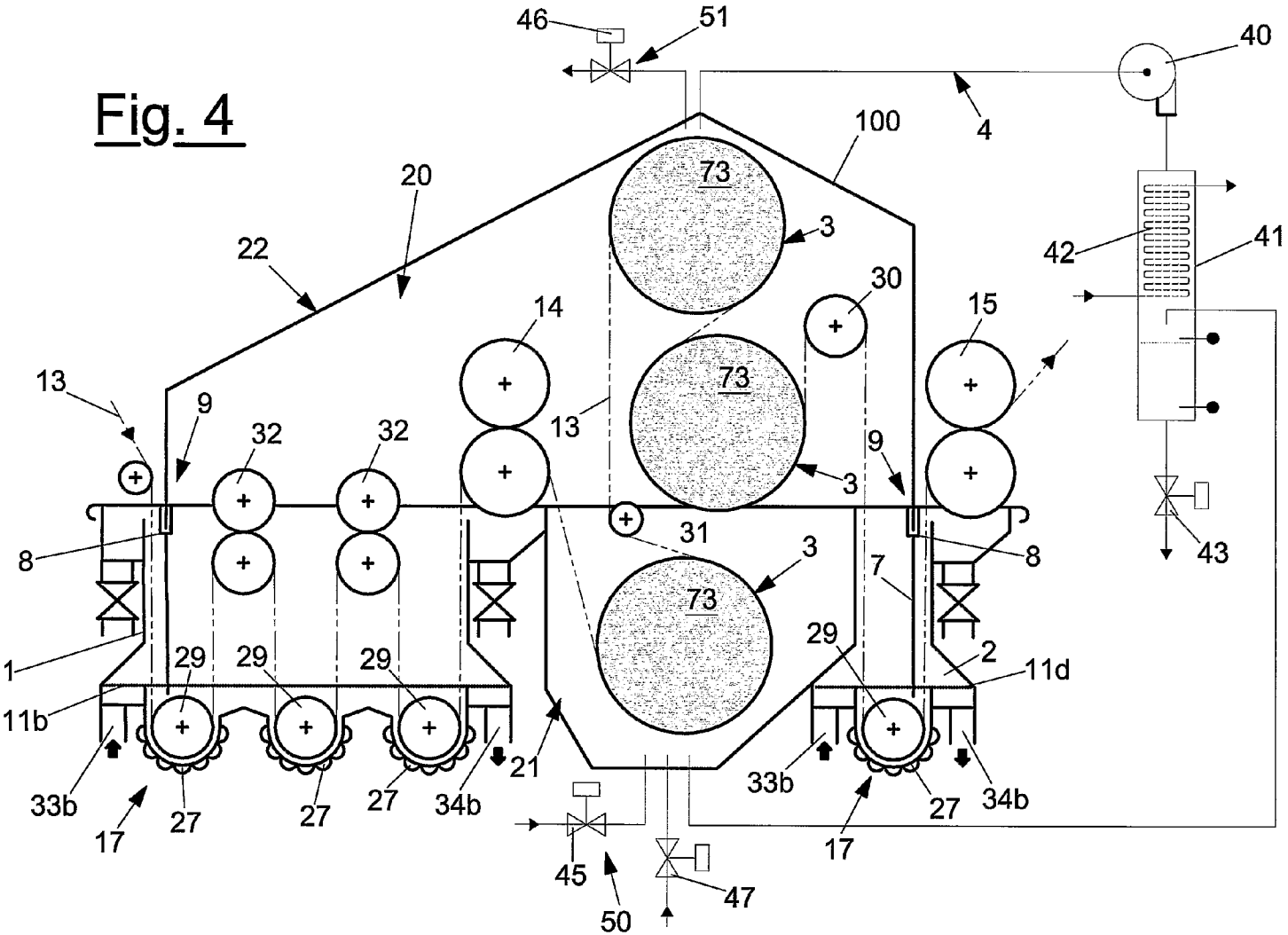
FIG. 4 shows a side view in elevation of a dyeing device according to the present invention used for a continuous dyeing process of the warp chain using indanthrene colorant.
Figure 5:
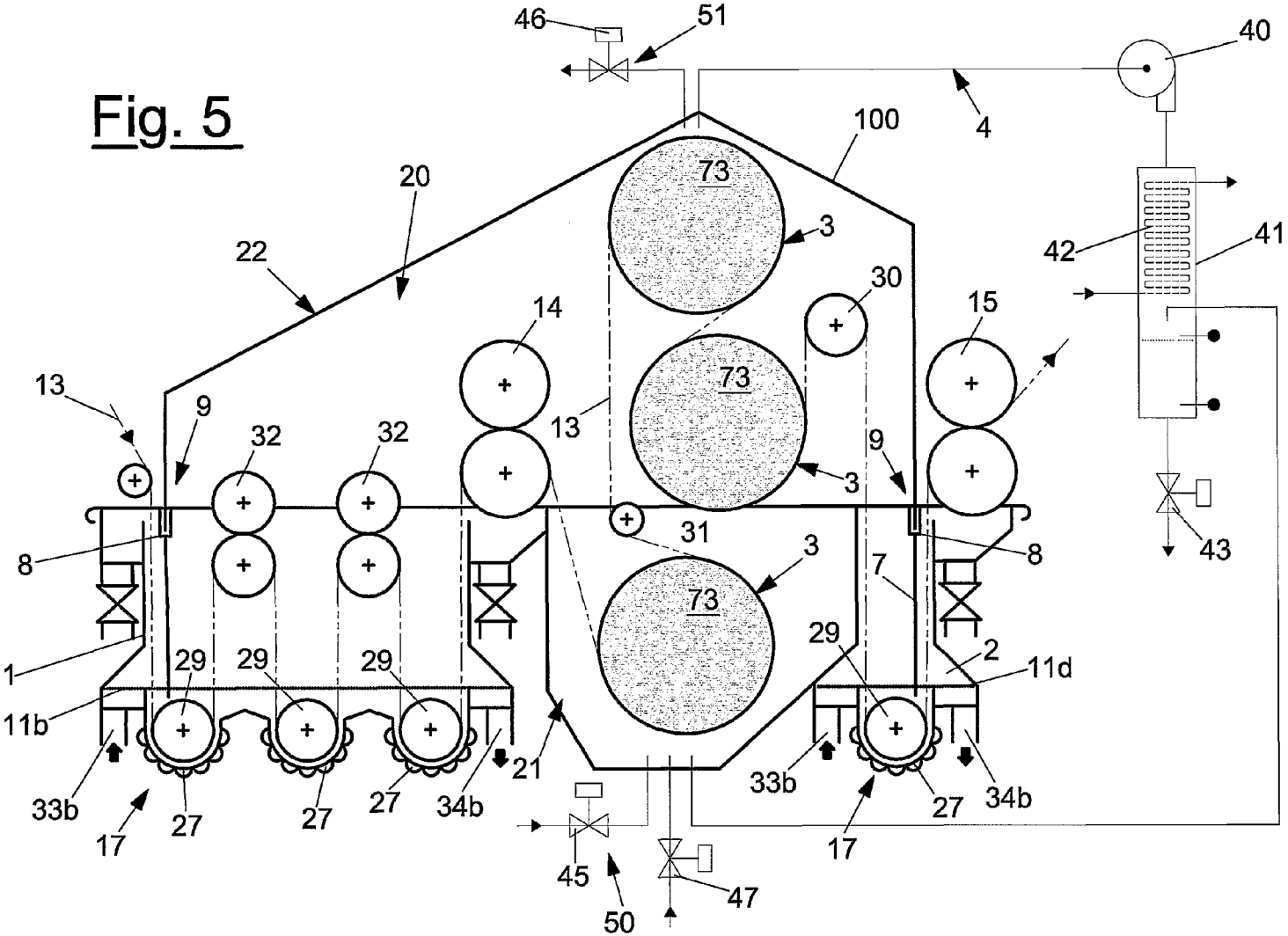
FIG. 5 shows a side view in elevation of a dyeing device according to the present invention used for a continuous dyeing process of the warp chain using reactive colorants.
Figure 6:
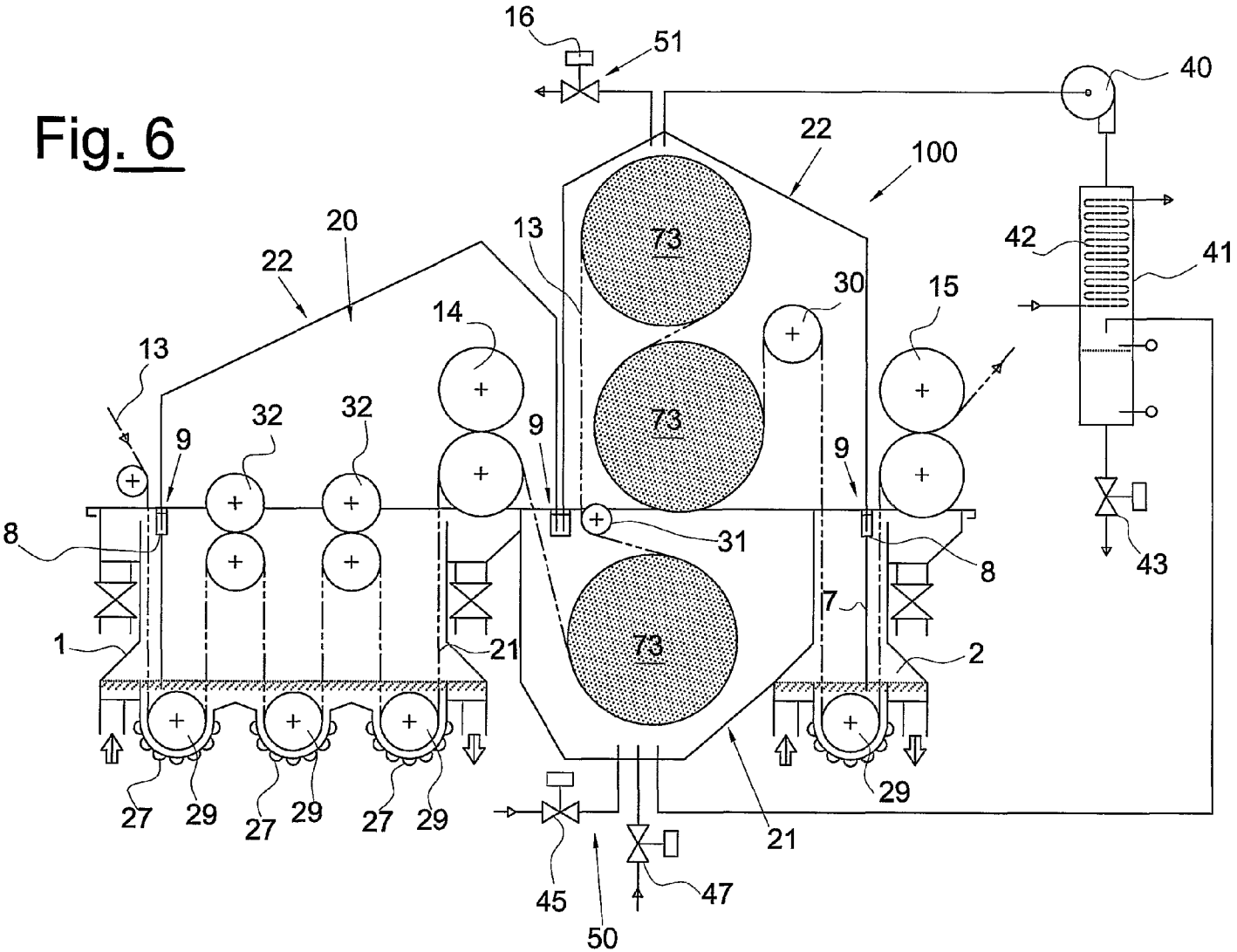
FIG. 6 shows a side view in elevation of an alternative embodiment of the dyeing device according to the present invention.

FIG. 6 shows an alternative embodiment of the present invention which is very similar to that shown in FIGS. 1 to 5, except that it presents two bases 21 and two hoods 22, that can be raised and closed hermetically on said bases 21 for cleaning and maintenance interventions. In this configuration, the hermetic sealing means 9 create a seal between each base and the corresponding hood.

The device 100 according to the present intervention provides for yarn dyeing as stated previously, using indigo, sulphur, indanthrene or reactive colorants. In particular, the indigo dyeing process using device 100 according to the present invention and illustrated in FIG. 2 includes the following stages:

a) immersion of the yarn 13 in the first compartment 1 containing the indigo dyeing bath 11*a* at high level;
b) squeezing of the yarn 13 upon exit from the bath 11*a* of first compartment 1 by applying strong pressure in a range between 5 and 12 tons;
c) direct heating of the yarn 13 to increase the diffusion of the colorant in the fiber and to dehydrate it in order to increase the absorption of the colorant in the following compartment 2;
d) immersion of the yarn 13 in the dyeing bath 11*c* in the second compartment 2 containing indigo at high level;
e) application of a second strong pressure squeezing on yarn 13 upon exit from the second compartment 2;
f) subjecting the yarn 13 to oxidation, in a known way, outside the device 100.

The aforesaid dyeing process is substantially carried out in an inert environment. In particular the stages from a) to d) are carried out in an inert environment without the yarn, impregnated with reduced bath liquid (leuco) coming into contact with the oxygen in the air, thus preventing the destruction of the hydrosulphite.

Furthermore, before beginning the indigo dyeing process, a flow of nitrogen or deoxygenated air is introduced into chamber 20 for an appropriate period of time using means 50, and the oxygen is extracted using means 51 in order to create a substantially inert environment.

The inert environment generated in this manner will be maintained in this state thanks to the perfectly hermetic sealing of chamber 20.

During the stages from a) to d), and in particular during stage c) steam is produced as a result of the dehydration of the yarn 13 heated by means 3. The nitrogen or deoxygenated air with the steam that has been generated in this manner, is drawn by the closed suction circuit 4 and sent to the heat exchanger 41. The steam is condensed inside the heat exchanger 41 to form water that is then discharged through valve 43, while the dehydrated deoxygenated air or nitrogen returns to the interior of the chamber 20.

Advantageously, according to the present process, the dyeing baths 11*a* and 11*c* contained in compartments 1 and 2 can be heated to facilitate the penetration in the yarn, or can be suitably cooled to increase the affinity of the indigo towards the fiber with a consequential increase in color intensity which, as is well known, increases as the temperature is reduced. In particular the bath 11*c* in the second compartment 2 is cooled by passing a coolant through the coil 27 in the second compartment if the heated yarn 13 on exit from the cylinders 73 raises the temperature of the bath too much.

Furthermore, in order to facilitate the penetration and uniformity of the colorant on the yarn in bath 11*a* in the first compartment 1, the yarn 13 is subjected to light pressure by elements 32 just before the bath.

Figure 3:
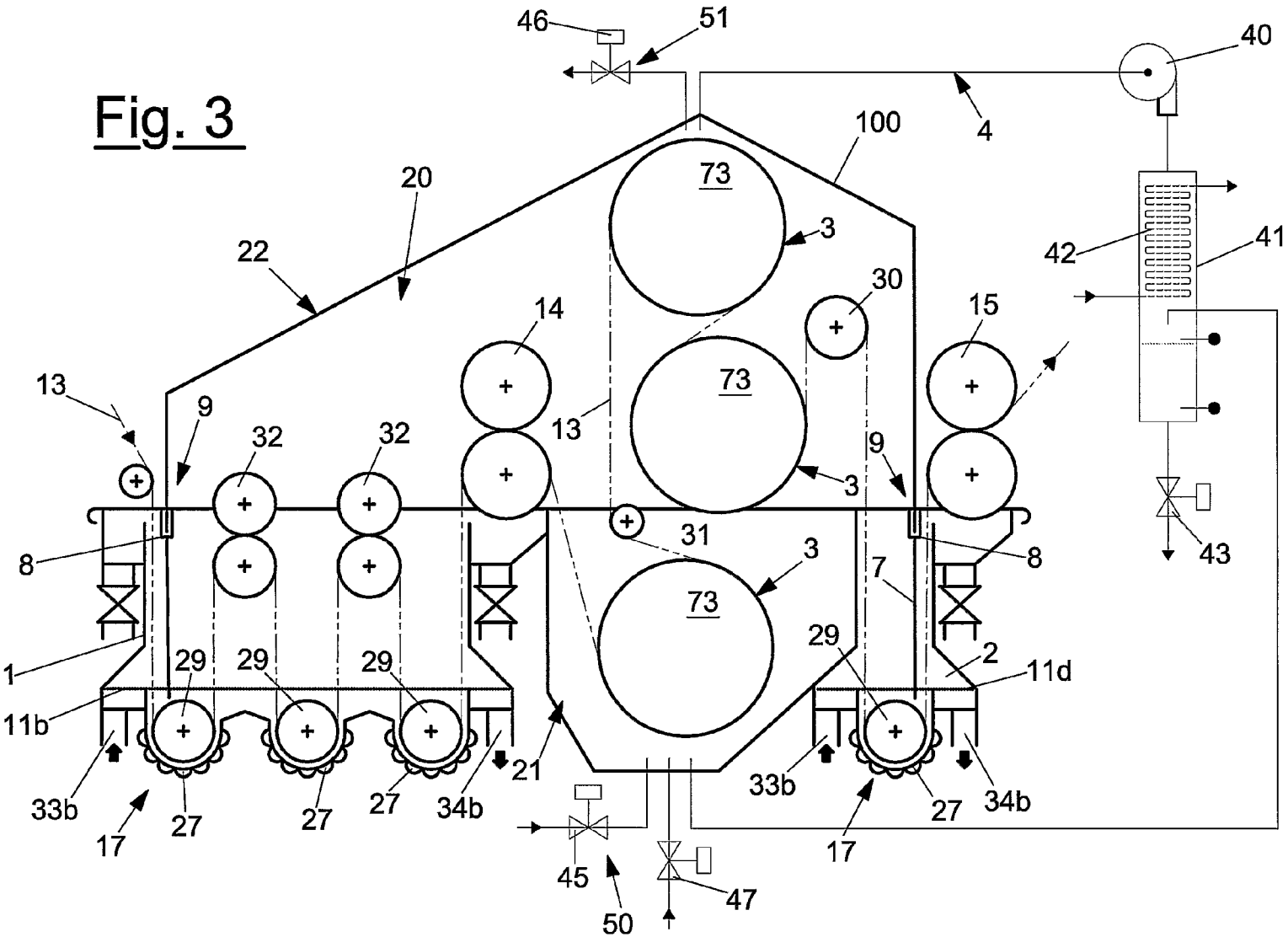
FIG. 3 shows a side view in elevation of a dyeing device according to the present invention used for a continuous dyeing process of the warp chain using a sulphur colorant.

FIG. 3 shows a continuous dyeing process using a sulphur-based colorant for yarn 13, employing the device 100 according to the present invention. To summarize, said process comprises the following stages:

a) immersion of the yarn 13 in the first compartment 1 containing a low level of dyeing bath 11*b* with a sulphur-based colorant (for dyeing with a black color, a high level bath is used);
b) squeezing by applying strong pressure ranging between 5 and 12 tons on the yarn 13 on exit from the bath 11*b* in the first compartment 1;
c) immersion of yarn 13 in the dyeing bath 11*d* with a sulphur colorant content at low level, in the second compartment 2 (a high level is used for dyeing black colors);
d) squeezing by applying strong pressure on the yarn 13 upon exit from the second compartment 2;
e) subjecting the yarn 13 to a steaming process in an appropriate steamer, not shown.

It is important to note that the steam that evaporates from the high temperature dyeing baths and from the yarn during the stages from a) to d) is drawn by the suction circuit 4 and discharged externally through a three-way discharge valve, not shown. In this situation, the hood 22 will prevent the dispersion of any smells in the surrounding external environment.

With this dyeing process, the yarn 13 is subjected to light squeezing by the squeezers 32 near the first compartment 1, to facilitate the penetration of the colorant in the yarn and make the color more uniform. Furthermore, with this type of sulphur-based colorant, the dyeing bath 11*b*, 11*d* contained in both the first compartment 1 and in the second compartment 2 is heated in a known way.

Basically, the dyeing process using sulphur differs from the process using indigo in the type of bath used and in the different application temperature, as well as because the cylinders 73 may not be heated, acting simply as return rollers, and because this process does not include an oxidation stage, but simply a steaming stage.

FIG. 4 shows a continuous dyeing process using indanthrene colorants for yarns 13 in the device 100 according to the present invention.

To summarize, said process comprises the following stages:

a) immersion of the yarn 13 in the first compartment 1 containing a low level of pigmentation bath 11*b* with an indanthrene-based colorant;
b) squeezing by applying strong pressure ranging between 5 and 12 tons on the yarn 13 upon exit from the bath 11*b* in the first compartment 1;
c) direct heating of the yarn 13 to dehydrate it in order to prevent hydrolysis of the bath contained in the second compartment;
d) immersion of the yarn 13 in the chemical bath 11*d* at low level in the second compartment 2;
e) squeezing by applying strong pressure on the yarn 13 upon exit from the second compartment;
f) subjecting yarn 12 to a steaming process in a suitable steamer, not shown.

In this dyeing stage, during the stages from a) to d), steam is also created and in particular, during stage c), steam is caused by the evaporation of water from the heated yarn 13. This steam is drawn in by the suction circuit 4 and discharged externally. Furthermore, it should be noted that in this process the dyeing bath 11*b* contained in the first compartment 1 is heated and the bath 11*d* in the second compartment 2 is cooled.

Also according to this dyeing process, the yarn 13 is subjected to light squeezing by the squeezer elements 32 near the first compartment 1 to facilitate the penetration of the colorant inside the yarn and make the coloring more uniform.

Lastly, FIG. 5 shows a continuous dyeing process with reactive colorants according to a two-stage method. In short, this process comprises the following stages:

a) immersion of the yarn 13 in the first compartment 1 containing a low level of dyeing bath 11*b* with a reactive colorant;

b) squeezing by applying strong pressure on the yarn 13 upon exit from the bath 11*b* in the first compartment 1;

c) direct heating of the yarn 13 to dehydrate it in order to prevent hydrolysis of the bath contained in the second compartment;

d) immersion of the yarn 13 in the saline alkaline bath 11*d* contained at low level in the second compartment 2;

e) squeezing by applying strong pressure on yarn 13 on exit from the second compartment;

f) subjecting the yarn 13 to a steaming process in a suitable steamer, not shown.

During the stages from a) to d), steam is created and in particular during stage c), steam is caused by the heating of yarn 13. The steam generated in this manner is drawn by the suction circuit 4 and discharged externally.

In this process using reactive colorants in two stages, the dyeing bath contained in the first compartment 1 is heated and the bath in the second compartment 2 is cooled.

In this case also, the yarn is subjected to light squeezing by means of the squeezer elements 32 near the first compartment 1, to facilitate the penetration of the colorant in the yarn and to make the color more uniform.

The device 100 and the processes according to the present invention therefore achieve the purposes outlines in the Brief Summary of The Invention, and contrary to machines and processes used up to now in indigo dyeing systems, the present invention provides for a considerable reduction in the number of the processing vats, and as a result a reduction in the cost of the equipment and a reduction in production reject material during batch changes.

Advantageously, the device 100 and the processes obtained using the device according to the present invention also provide for working in an inert environment when using indigo, thus permitting the dehydration of the yarn without the oxidation of the colorant, as well as a considerable reduction of the ordinary consumption of hydrosulphite and soda.

The heating and/or dehydration of the yarn by the heating means 3 according to the present invention provides an increase in the diffusion of the colorant in the yarn and for the pick-up (colorant absorption capacity) of the yarn, thus making the dyeing process more efficient, economical and environmentally-friendly.

In other terms, in the case of indigo dyeing, for the same level of color tone and intensity obtained on the yarn, the present device 100 and the dyeing processes using the device 100 provide for the possibility of considerably reducing the number of over-dyeing steps.

The device according to the present invention also offers the possibility of dyeing small batches, or smaller yardage, an aspect increasingly in demand in the marketplace. Indeed, it must be remembered that in traditional installations, the minimum pieces that can be dyed depends on the length of the yarn that constitutes the total path of the installation.

In order to obtain medium or dark color intensity, traditional dyeing installations using indigo require a large number of vats and as a result the installation size and costs are increased proportionally.

The present invention has been described exemplary embodiments, which are not to be considered limiting by any means. It should be understood that variations and/or modifications to the above description can be applied by those skilled in the art while remaining within the scope of protection as defined in the appended claims.

The invention claimed is:

1. A continuous dyeing device using indigo and/or other colorants to color a yarn in a warp chain and/or in a fabric, comprising:

at least a first and a second dyeing compartments each adapted to contain one or more dyeing baths;

at least one squeezing element interposed between the first and the second dyeing compartments;

at least one means for heating and/or dehydrating the yarn, the at least one means for heating and/or dehydrating increasing diffusion of a colorant in a fiber of the yarn and absorption of the colorant in the yarn, the at least one means for heating and/or dehydrating being located between the first and the second dyeing compartments and downstream of the at least one squeezing element;

a hermetically sealed chamber containing, at least partially, the first and the second dyeing compartments, the at least one squeezing element, and the means for heating and/or dehydrating the yarn; and at least one second squeezing unit positioned outside the hermetically sealed chamber downstream of said second dyeing compartment.

2. The device according to claim 1, wherein the at least first and second dyeing compartments comprise on their bottoms, at least one means for indirect heating or cooling, the at least one means for indirect heating or cooling having no contact with the dyeing baths contained in the first and second dyeing compartments.

3. The device according to claim 2, wherein the at least one means for indirect heating or cooling the dye baths forms a cavity near the bottom of the first and/or second dyeing compartments and comprises at least one coil for circulating a heating or cooling fluid.

4. The device according to claim 1, wherein the hermetically sealed chamber comprises at least one base and at least one hood that can be raised from said base for cleaning and maintenance interventions, the at least one hood being configured to be hermetically closed over said base.

5. The device according to claim 4, wherein said hermetically sealed chamber comprises two bases and two hoods that can be raised from said bases for cleaning and maintenance interventions, and that are configured to be hermetically closed over said bases.

6. The device according to claim 4, wherein said hermetically sealed chamber comprises hermetic sealing means.

7. The device according to claim 6, wherein said hermetic sealing means comprise at least one gasket interposed between said at least one hood and said at least one base.

8. The device according to claim 6, wherein said hermetic sealing means comprise a hydraulic seal having at least one dividing wall for each of the dyeing compartments wherein said dividing wall is immersed at one end, at least partially in one or more of the dyeing baths, and wherein said dividing wall is equipped with a seat adapted to be hermetically coupled with said at least one hood.

9. The device according to claim 1, wherein the means for heating and/or dehydrating the yarn comprise at least one heatable cylinder positioned between the at least one squeezing element and the second dyeing compartment, the yarn traveling over the at least one heatable cylinder before immersing in a dyeing bath contained in the second dyeing compartment.

10. The device according to claim 1, wherein the means for heating and/or dehydrating the yarn comprise at least one infrared source adapted to heat said yarn by direct irradiation.

11. The device according to claim 1, wherein the means for heating and/or dehydrating the yarn comprise at least one microwave or radio frequency source adapted to directly heat the yarn downstream of said squeezing element.

12. The device according to claim 1, wherein the means for heating and/or dehydrating the yarn comprise at least one source of at least one flow of dehumidified hot fluid adapted to heat the yarn by convection.

13. The device according to claim 1, further comprising at least one intermediate squeezing unit positioned over said first dyeing compartment and adapted to perform a squeezing action on said yarn during the period in which said yarn remains in said first dyeing compartment.

14. The device according to claim 1, further comprising a plurality of guide rollers for the yarn inside said hermetically sealed chamber

15. The device according to claim 1, further comprising a closed fluid and steam suction circuit for drawing steam from said hermetically sealed chamber and for returning dehumidified fluid back into the interior of said hermetically sealed chamber.

16. The device according to claim 15 wherein the closed fluid and steam suction circuit comprises at least one valve element for discharging the steam drawn from said hermetically sealed chamber towards the exterior of the hermetically sealed chamber.

17. The device according to claim 15, wherein the closed fluid and steam suction circuit comprises at least one steam suction means for drawing steam from said hermetically sealed chamber and at least one heat exchanger for condensing the steam and for returning dehumidified fluid to said hermetically sealed chamber.

18. The device according to claim 1, further comprising means for introducing deoxygenated air and/or nitrogen into said hermetically sealed chamber and means for expelling oxygen from said chamber, thereby creating an inert processing environment inside said hermetically sealed chamber.

19. The device according to claim 1, wherein said first and second dyeing compartments each comprise at least one inlet and one outlet configured for liquid overflow.

20. The device according to claim 1, wherein the first dyeing compartment has a larger yarn containment capacity than the second dyeing compartment.

21. The device according to claim 1, wherein the dyeing compartments are structured to operate with different dyeing baths.

22. The device according to claim 1, wherein the dyeing compartments are configured to vary bath level according to a predetermined dyeing process.

23. A continuous process for dyeing a yarn using indigo comprising the steps of:

providing a continuous dyeing device comprising, at least a first and a second dyeing compartments each adapted to contain a dyeing bath, at least one squeezing element interposed between the first and the second dyeing compartments, at least one means for heating and/or dehydrating the yarn, the at least one means for heating and/or dehydrating increasing diffusion of a colorant in a fiber of the yarn and absorption of the colorant in the yarn, the at least one means for heating and/or dehydrating being located between the first and the second dyeing compartments and downstream of the at least one squeezing element, a hermetically sealed chamber containing, at least partially, the first and the second dyeing compartments, the at least one squeezing element, and the means for heating and/or dehydrating the yarn, and at least one second squeezing unit positioned outside the hermetically sealed chamber downstream of said second dyeing compartment;

immersing the yarn in said first compartment containing the dyeing bath;

squeezing the yarn upon exit from the dyeing bath of said first compartment;

heating said yarn to increase the diffusion of the colorant in the fiber and to dehydrate the yarn, thereby increasing the absorption of the colorant in the second compartment;

immersing said yarn in the dyeing bath contained in said second compartment;

performing a second squeezing action on the yarn upon exit from said second compartment; and subjecting the yarn to oxidation.

24. The process according to claim 23, wherein the steps of immersing the yarn in said first compartment containing the dyeing bath, squeezing, heating, and immersing said yarn in the dyeing bath contained in said second compartment are performed in an inert environment.

25. The process according to claim 23, wherein, prior to beginning the dyeing process, a flow of nitrogen and/or deoxygenated air is introduced into said chamber for a period of time sufficient to obtain an inert environment inside said chamber.

26. The process according to claim 23, wherein, during one or more of the steps of immersing the yarn in said first compartment containing the dyeing bath, squeezing, heating and immersing said yarn in the dyeing bath contained in said second compartment, steam evaporates from the yarn, wherein fluid containing the steam evaporating from the yarn is drawn by a suction circuit and condensed producing a dehumidified fluid, and wherein the dehumidified fluid is introduced back into the chamber.

27. The process according to claim 23, wherein the one or more dyeing baths contained in the first compartment are heated.

28. The process according to claim 23, wherein the one or more dyeing baths contained in said first and second first compartments are heated or cooled.

29. A continuous process for dyeing a yarn using sulphur colorant comprising the following steps:

providing a continuous dyeing device comprising, at least a first and a second dyeing compartments each adapted to contain a dyeing bath at least one squeezing element interposed between the first and the second dyeing compartments, at least one means for heating and/or dehydrating the yarn, the at least one means for heating and/or dehydrating increasing diffusion of a colorant in a fiber of the yarn and absorption of the colorant in the yarn, the at least one means for heating and/or dehydrating being located between the first and the second dyeing compartments and downstream of the at least one squeezing element, a hermetically sealed chamber containing, at least partially, the first and the second dyeing compartments, the at least one squeezing element, and the means for heating and/or dehydrating the yarn, and at least one second squeezing unit positioned outside the hermetically sealed chamber downstream of said second dyeing compartment;

immersing said yarn in said first compartment containing the dyeing bath with sulphur colorant;

squeezing the yarn upon exit from the dyeing bath in said first compartment;

immersing said yarn in said second compartment containing a the dyeing bath with sulphur colorant;

squeezing the yarn upon exit from said second compartment; and subjecting the yarn to steaming.

30. The process according to claim 29, wherein, during one or more of steps of immersing said yarn in said first compartment containing the dyeing bath with sulphur colorant, squeezing the yarn upon exit from the dyeing bath in said first compartment, immersing said yarn in said second compartment containing the dyeing bath with sulphur color, and squeezing the yarn upon exit from said second compartment, steam evaporates from said yarn, and wherein the evaporated steam is drawn by a suction circuit and discharged externally of the device.

31. A continuous process for dyeing a yarn using indanthrene colorant comprising the following steps:

providing a continuous dyeing device comprising, at least a first and a second dyeing compartments each adapted to contain a bath, at least one squeezing element interposed between the first and the second dyeing compartments, at least one means for heating and/or dehydrating the yarn, the at least one means for heating and/or dehydrating increasing diffusion of a colorant in a fiber of the yarn and absorption of the colorant in the yarn, the at least one means for heating and/or dehydrating being located between the first and the second dyeing compartments and downstream of the at least one squeezing element, a hermetically sealed chamber containing, at least partially, the first and the second dyeing compartments, the at least one squeezing element, and the means for heating and/or dehydrating the yarn, and at least one second squeezing unit positioned outside the hermetically sealed chamber downstream of said second dyeing compartment;

immersing said yarn in said first compartment, wherein the bath is a pigmentation bath with indanthrene colorant;

squeezing the yarn upon exit from the pigmentation bath in said first compartment;

heating and dehydrating said yarn, in order to prevent hydrolysis of the bath in the second compartment;

immersing said yarn in the bath contained in said second compartment, wherein the bath is a chemical bath;

second squeezing of the yarn upon exit from the second compartment; and subjecting the yarn to steaming.

32. The process according to claim 31, wherein, during one or more of the steps of immersing said yarn in said first compartment squeezing the yarn upon exit from the pigmentation bath in said first compartment, heating and dehydrating said yarn, and immersing said yarn in the bath contained in said second compartment, steam evaporates from said yarn and is drawn by a suction circuit, and wherein said steam is discharged externally of the device.

33. The process according to claim 32, wherein the pigmentation bath contained in said first compartment is heated, and the bath in said second compartment is cooled.

34. A continuous process for dyeing a yarn using reactive colorants according to a two stage method, the continuous process comprising the following steps:

providing a continuous dyeing device comprising, at least a first and a second dyeing compartments each adapted to contain a bath, at least one squeezing element interposed between the first and the second dyeing compartments, at least one means for heating and/or dehydrating the yarn, the at least one means for heating and/or dehydrating increasing diffusion of a colorant in a fiber of the yarn and absorption of the colorant in the yarn, the at least one means for heating and/or dehydrating being located between the first and the second dyeing compartments and downstream of the at least one squeezing element, a hermetically sealed chamber containing, at least partially, the first and the second dyeing compartments, the at least one squeezing element, and the means for heating and/or dehydrating the yarn, and at least one second squeezing unit positioned outside the hermetically sealed chamber downstream of said second dyeing compartment;

immersing said yarn in said first compartment, wherein the bath is a dyeing with the reactive colorants;

squeezing the yarn upon exit from the bath in said first compartment;

heating and dehydrating said yarn, in order to prevent hydrolysis of the dyeing bath contained in the second compartment;

immersing said yarn in said second compartment, wherein the bath is in a saline alkaline bath;

second squeezing of the yarn upon exit from the second compartment; and subjecting the yarn to steaming.

35. The process according to claim 34, wherein, during one or more of the steps of immersing said yarn in said first compartment, squeezing the yarn upon exit from the bath in said first compartment, heating and dehydrating said yarn, and immersing said yarn in said second compartment, steam evaporates from said yarn and is drawn by a suction circuit and discharged externally of the device.

36. The process according to claim 34, wherein the bath in said first compartment is heated, and wherein the bath in the second compartment is cooled.

37. The process according to claim 34, wherein the yarn is subjected to intermediate squeezing at said first compartment, thereby facilitating penetration of the colorant in the yarn and causing a more uniform coloring of the yarn.

* * * * *